United States Patent [19]

Farris

[11] 4,038,949

[45] Aug. 2, 1977

[54] ROTARY-RADIAL INTERNAL COMBUSTION ENGINE

[76] Inventor: Victor W. Farris, 840 S. Ocean Blvd., Palm Beach, Fla. 33480

[21] Appl. No.: 568,675

[22] Filed: Apr. 16, 1975

[51] Int. Cl.[2] ..... F02B 57/06

[52] U.S. Cl. ..... 123/44 D; 123/44 C; 123/44 E

[58] Field of Search ..... 123/44 E, 43, 44 D, 123/44 C, 44 R, 43 R, 55 AA, 56 C

[56] References Cited

U.S. PATENT DOCUMENTS

| | | | |
|---|---|---|---|
| 1,443,282 | 1/1923 | Scott | 123/44 C |
| 1,612,046 | 12/1926 | Owens | 123/44 E |
| 1,765,237 | 6/1930 | King | 123/55 AA |
| 1,830,046 | 11/1931 | White | 123/55 AA |
| 2,389,709 | 11/1945 | Anders | 91/197 |
| 3,220,390 | 11/1965 | Grunstra | 123/44 C |
| 3,517,651 | 6/1970 | Graybill | 123/44 C |
| 3,584,610 | 6/1971 | Porter | 123/44 E |

FOREIGN PATENT DOCUMENTS

| | | | |
|---|---|---|---|
| 337,962 | 3/1904 | France | 91/197 |

*Primary Examiner*—Clarence R. Gordon
*Attorney, Agent, or Firm*—Bernard H. Lemlein

[57] ABSTRACT

A rotary-radial internal combustion engine wherein a piston-containing cylinder housing and cam means are mounted in an engine housing for relative rotary motion with respect to each other; said cylinder housing including diametrically opposite combustion chambers having mounted for reciprocation therein rigidly linked pistons provided with cam follower means engaging said cam means; said engine housing being provided with fuel intake means for feeding pressurized fuel to said combustion chambers, means for firing said fuel in said combustion chambers, and burnt fuel scavenging means for exhausting burnt fuel from said combustion chambers; the combination of said relative rotary motion between said cylinder housing and said cam means, and said reciprocatory motion of said pistons, producing per engine revolution piston thrusts numerically greater than the number of combustion chambers in said cylinder housing; said piston thrusts being translated into torque which is applied to an engine drive shaft.

37 Claims, 11 Drawing Figures

| | FIRING | COMPRESSING | EXPANDING | INTAKE | EXHAUST |
|---|---|---|---|---|---|
| R1 | X | | | | |
| 2 | | | | X | X |
| 3 | X | | | | |
| 4 | | | | X | X |
| 5 | X | | | | |
| 6 | | | | X | X |
| F1 | | X | | | |
| 2 | | | X | | |
| 3 | | X | | | |
| 4 | | | X | | |
| 5 | | X | | | |
| 6 | | | X | | |

| | | | | | |
|---|---|---|---|---|---|
| R1 | | | X | | |
| 2 | | X | | | |
| 3 | | | X | | |
| 4 | | X | | | |
| 5 | | | X | | |
| 6 | | X | | | |
| F1 | X | | | | |
| 2 | | | | X | X |
| 3 | X | | | | |
| 4 | | | | X | X |
| 5 | X | | | | |
| 6 | | | | X | X |

| | | | | | |
|---|---|---|---|---|---|
| R1 | | | | X | X |
| 2 | X | | | | |
| 3 | | | | X | X |
| 4 | X | | | | |
| 5 | | | | X | X |
| 6 | X | | | | |
| F1 | | | X | | |
| 2 | | X | | | |
| 3 | | | X | | |
| 4 | | X | | | |
| 5 | | | X | | |
| 6 | | X | | | |

| | | | | | |
|---|---|---|---|---|---|
| R1 | | X | | | |
| 2 | | | X | | |
| 3 | | X | | | |
| 4 | | | X | | |
| 5 | | X | | | |
| 6 | | | X | | |
| F1 | | | | X | X |
| 2 | X | | | | |
| 3 | | | | X | X |
| 4 | X | | | | |
| 5 | | | | X | X |
| 6 | X | | | | |

ROTARY-RADIAL INTERNAL COMBUSTION ENGINE

This invention relates to internal combustion engines.

Such engines have heretofore incorporated crankshafts, cam shafts, connecting rods, wrist pins, valves, valve rods, valve seats, springs, rocker arms, excessive bearings, and many other complex components which are costly to manufacture and maintain.

Further, such engines have been inefficient in producing drive shaft torque, being limited in displacement per engine revolution to the area of each cylinder bore and length of piston stroke multiplied by the number of cylinders.

Still further, such engines have high ratios of weight and bulk to power output, and guiding ratios of piston diameter to piston height, and piston height to cylinder length resulting in scoring, piston slap, excessive wear and friction.

It is, therefore, an object of the present invention to eliminate the foregoing shortcomings by providing a rotary-radial design rather than an in-line arrangement. By so doing, there is attained a compact, moderate speed, low cost, low weight and bulk to horsepower engine that will develope maximum useful torque with a minimum of parts. Additionally, the design of the engine requires simple manufacturing techniques and tooling practices, with the elimination of many conventional parts, for example, those above referred to.

It is another object of the present invention to provide an engine utilizing a modified 2-cycle principle in which, in effect, the displacement physically built into the engine is extended for each engine revolution by providing piston thrusts per revolution numerically greater than the number of cylinders and pistons actually present.

It is a further object of the present invention to employ porting and sealing techniques which are simple to manufacture and maintain; and to hold fuel condensation to a minimum, resulting in increased fuel energy to work conversion, and greatly reduced polution.

It is a further object of the present invention to provide an engine having positive pressure on the intake and negative pressure on the exhaust, these functions being substantially isolated from each other to minimize temperature effects. The construction of the engine is such as to result in low fuel condensation, cleaner and more complete fuel charges, minimal back pressure and cleaner fuel burning. It reduces leakage and intake and exhaust intermingling to a minimum. It incorporates constantly loaded seals to absorb wear and reduce necessary tolerances. It employs small diameter pistons and short cylinders, resulting in short cylinder walls.

The above and other advantages of the present invention will become more apparent as the following detailed description thereof, when taken in connection with the accompanying drawings, progresses.

In said drawings.

Figure 1:
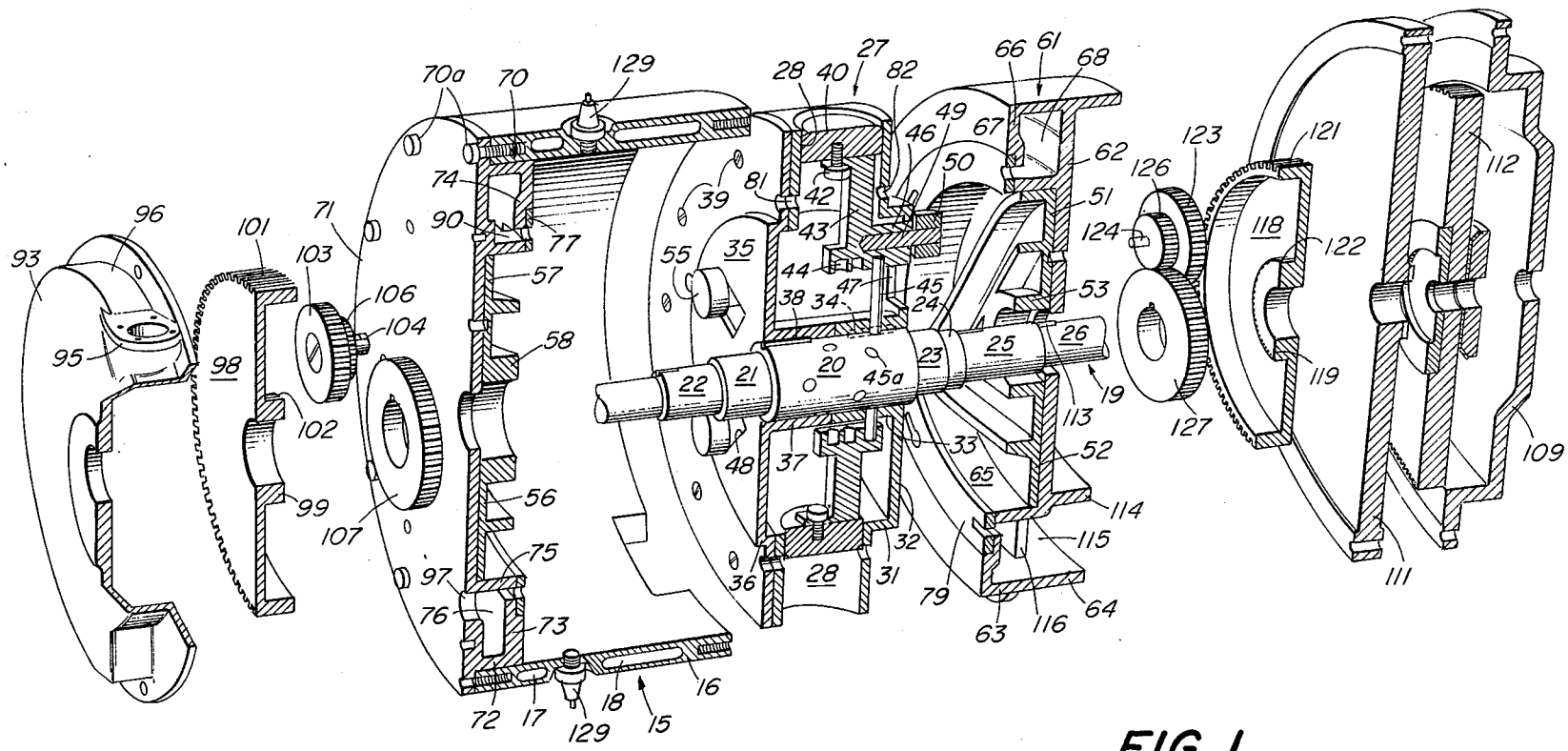
FIG. 1 is an exploded, perspective view of one embodiment of the rotary-radial engine of the present invention, said view being taken substantially along the longitudinal center of said engine.
Figure 2:
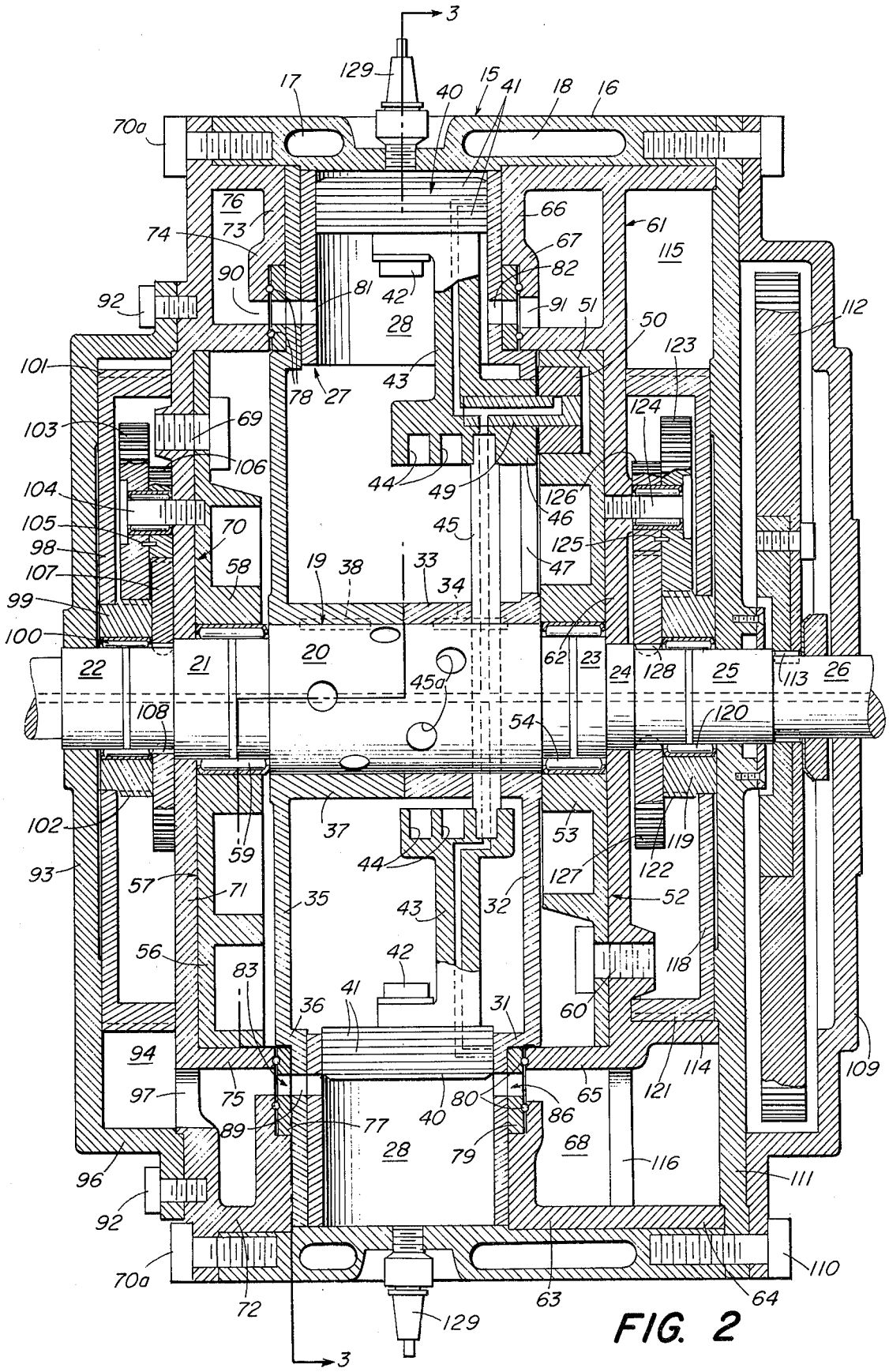
FIG. 2 is an assembled and enlarged, longitudinal sectional view taken substantially through the vertical center of the engine.

Referring now more in detail to the rotary-radial internal combustion engine of the present invention, with particular reference to the embodiment thereof shown in FIGS. 1 through 7 of the accompanying drawings, the numeral 15 generally designates an outer cylindrical housing, the peripheral wall 16 of which includes annular channels 17 and 18 which communicate in a conventional manner with pumping means (not shown) for circulating cooling fluid through said channels.

Rotatably mounted in the housing 15, as will hereinafter be more specifically described, is a main drive shaft generally designated by the reference character 19. The shaft 19 is provided with a central main stepped portion 20 having auxiliary stepped portion 21 and 22 extending from one side thereof, toward the front end of the engine, and having additional auxiliary stepped portions 23, 24, 25 and 26 extending from the other side thereof, toward the rear of the engine.

Mounted upon the central stepped portion 20 of the shaft 19 is a rotor or piston-containing cylinder housing generally designated by the reference character 27. Said rotor is provided with a plurality, here shown as 12, peripherally disposed bores or combustion chambers 28 separated by V-shaped segments 29. The outer surface of the rotor 27 has a close fit with the inner surface of the wall 16 of the engine housing 15 and in order to isolate the chambers 28 from each other, the segments 29 are each provided with pairs of transversely disposed sealing members 30.

At the inner ends of the chambers 28, the rotor 27 is provided, on one side thereof, with an outwardly directed offset portion 31 and a circular plate 32 having at its inner edge an inwardly directed hub 33 which is keyed, as at 34, to the central step 20 of the shaft 19.

The other side of the rotor 27 is closed by a circular cover plate 35 having an outwardly directed offset portion 36 aligned with the offset portion 31, the inner edge of said plate being provided with an inwardly directed hub 37 which is keyed, as at 38, to the central step 20 of the shaft 19. Said cover plate is fastened to the rotor 27 by a plurality of bolts 39 which are threaded into the rotor segments 29 between the chambers 28.

Mounted for reciprocation in each of the chambers 28 is a piston 40 provided, in the usual manner, with piston rings 41. The pistons 40, are preferably, of a pancake or wafer-like type in which the piston diameter to piston height has a ratio of not less than 2 to 1.

Secured to the underside of each of the pistons 28, as by bolts 42, is a strut 43 and, in the 12-cylinder example of the present invention being described, each such strut is provided at its inner end with 3 axially aligned sockets 44.

Diametrically opposite struts 43 and, hence, diametrically opposite pistons 40, are connected to each other by rigid links 45 which freely pass through openings **45*a* formed in the central step 20 of the shaft 19, there being six such openings axially arranged along said step 20 and angularly displaced from each other by 60°. The opposite ends of said links are provided, respectively, with right and lefthanded threads for engagement in corresponding threads in the strut sockets 44. Each link 45** is of such length that when each piston connected thereto is at the top of its stroke, the diametrically opposite piston is at the bottom of its stroke.

By virtue of the diametrically opposite, rigidly connected piston construction just described, the present invention enables the attainment of piston guiding ratios of not less than 3 to 1, thereby eliminating the galling, hanging, binding, cocking, excessive side wear and friction usually associated with the in-line arrangement of standard internal combustion engines.

Three of the struts 43, which are angularly displaced from each other by 120 degrees and which, as will hereinafter be more fully described, engage a cam disposed on one side of the rotor 27, toward the rear of the engine, are each provided with arms 46 directed toward the rear of the engine. Each arm engages and is guided by a radial slot 47 in the plate 32, and is provided with ears **46*a* which overlap the slot 47 and slidably engage the inner surface of the plate 32. Similarly, three others of the struts 43, which are angularly displaced from each other by 120 degrees and angularly displaced from the three struts above referred to by 60 degree, and which, as will hereinafter be more fully described, engage a cam disposed on the other side of the rotor, toward the front end of the engine, are each provided with like arms 46 directed toward the front end of the engine. Each such arm engages and is guided by a radial slot 48 in the plate 35 and is provided with ears (not shown) similar to the above referred to ears 46*a* which overlap the slot 47 and slidingly engage the inner surface of the plate 35**.

Carried by each of the strut arms 46 is a stud 49 having at the outer end thereof a rotatably mounted cam follower roller 50, the three rearwardly directed cam follower rollers engaging a channeled cam 51 formed on a plate 52 having at its inner edge a forwardly directed hub 53. The hub surounds the stepped portion 23 of the shaft 19 and needle bearings 54 are provided intermediate said hub and said shaft step.

Three forwardly directed cam follower rollers 55 engage a channeled front cam 56 formed on a plate 57 having at its inner edge a reawardly directed hub 58. The hub 58 surrounds the stepped portion 21 of the shaft 19 and needle bearings 59 are provided between said hub and said shaft step.

Figure 3:
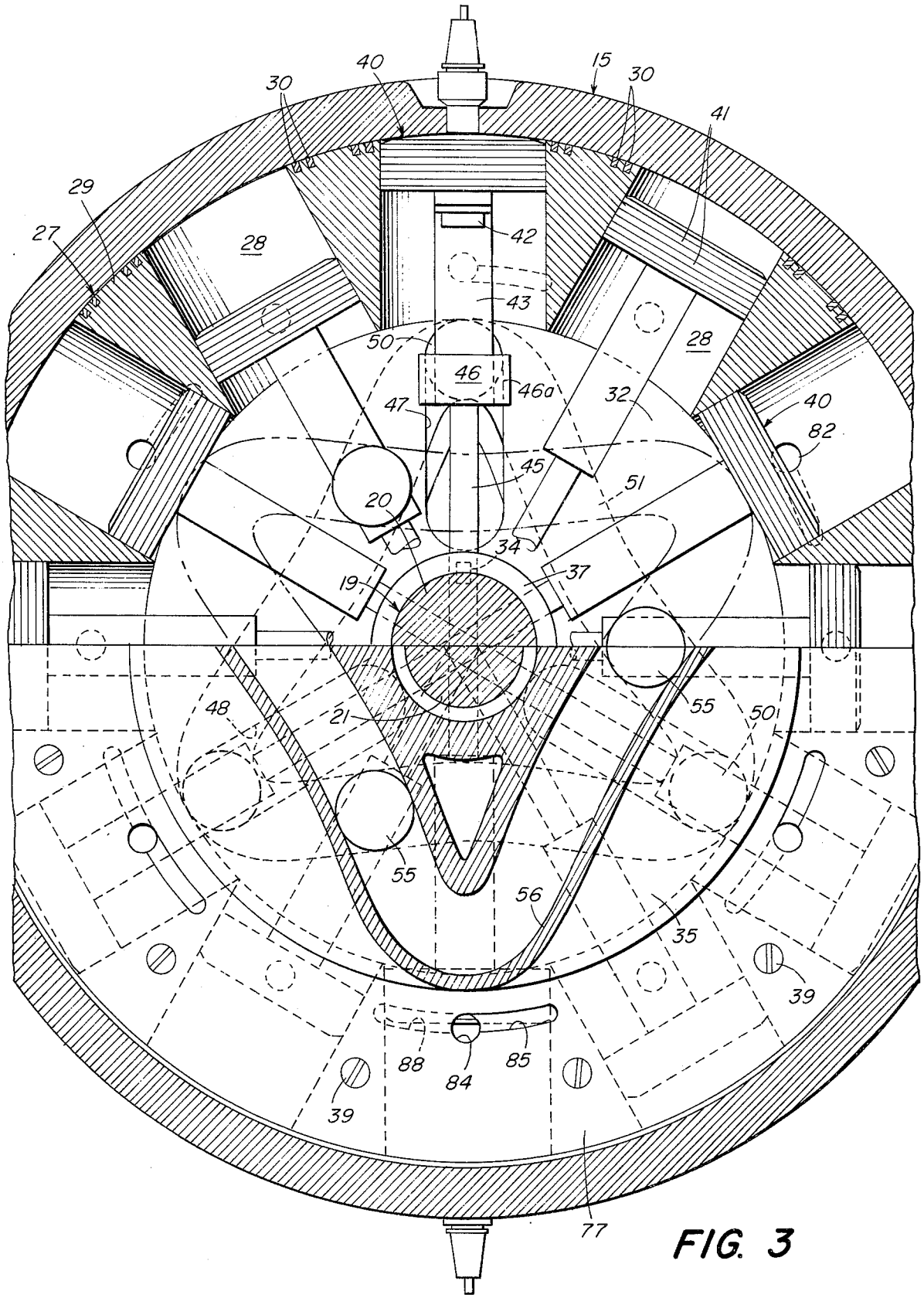
FIG. 3 is a transverse sectional view taken substantially along line 3—3 of FIG. 2.
Figure 4:
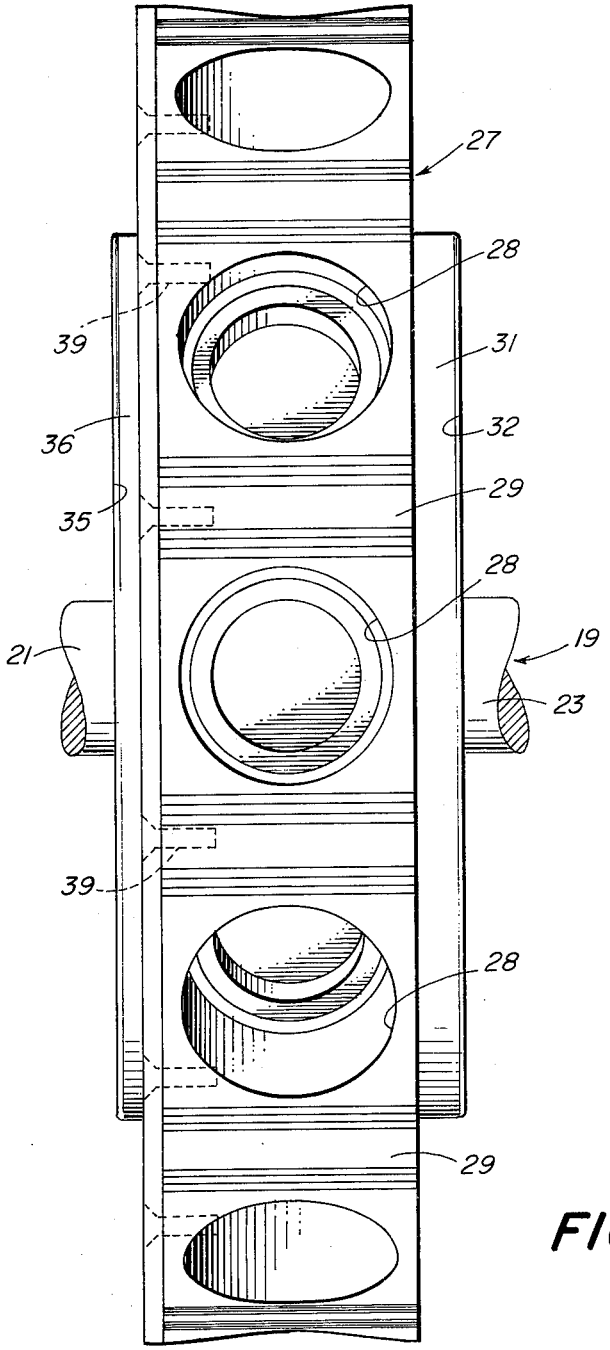
FIG. 4 is a peripheral view of a rotating cylinder housing of the engine.
Figure 8:
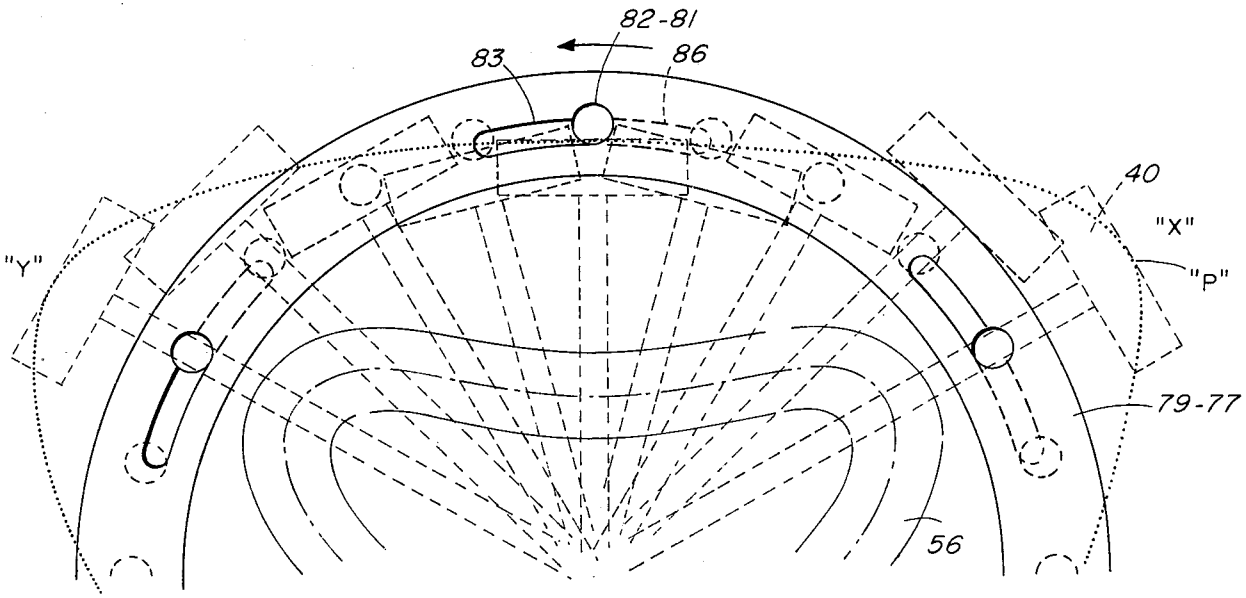
FIG. 8 is a phantom view showing sequential positions of a particular piston of the engine as said piston travels through a portion of its combined receiprocatory and rotary motions.

The cams 51 and 56, as will best be understood from a study of FIG. 3 of the drawings, are angularly displaced from each other by 60° and are so sloped that (1) points thereon coincident with the center lines of alternate pistons 40 correspond, respectively, to the top and bottom of the strokes of such pistons, (2) points intermediate said first-named points lie along the a curve bearing a selected relationship to the strokes of said pistons and the rate of expansion of the gases resulting from the firing of fuel in the combustion chambers, (3) said curve results in an immediate conversion of piston thrust to torque on the rotor shaft, and (4) unlike the energy consuming lost motion which occurs in the transmission of piston thrust to a drive shaft through a conventional crank, such piston thrust, as will later be demonstrated in the description of FIG. 8 of the accompanying drawings, is translated into torque with a minimum related rate of incremental rotation of the rotor shaft.

In the present invention, the mechanical coupling between the pistons 40 and the cams 51 and 56 is such that the thrust of such pistons generates a reactive force in such cams which, in turn, through the rotor 27 and keys 34 and 38, applies torque to the shaft 19.

The rear cam 51 is held against rotation by securing the plate 52 thereof, as by bolts 60, to an exhaust manifold housing which surrounds said cam and which is generally designated by the reference character 61. Said manifold housing, which is fixed in the engine housing 15, comprises a circular plate 62 having at its outer edge an annular wall which includes forwardly and rearwardly directed portions 63 and 64. Intermediate the inner and outer edges of the plate 62, the latter is provided with a forwardly directed annulus 65. The forwardly directed portion 63 of the peripheral wall of the plate 62 has a reentrant portion 66 having an offset 67. The plate 62, together with its wall portion 63, annulus 65 and reentrant portion 66, present, as will hereinafter be more fully described, an annular burnt fuel exhausting manifold 68.

The front cam 56 is held against rotation by securing the plate 57 thereof, as by bolts 69, to an intake manifold housing which surrounds said cam and which is generally designated by the reference character 70. Said manifold housing is fixed by bolts **70*a* in the engine housing 15 and comprises a circular plate 71 having at its outer edge an inwardly directed annular wall 72 having a reentrant portion 73 provided with an offset 74. Intermediate the inner and outer edges of the plate 71, the latter is provided with a rearwardly directed annulus 75 and said plate 71, together with its outer wall 72, reentrant portion 73 and intermediate annulus 75, present, as will hereinafter be more fully described, an annular fuel intake manifold 76**.

Recessed in the offset 36 of the cover plate 35 and the offset 74 of the reentrant portion 73 of the intake manifold housing is an annular intake seal ring 77, said ring being pressed against said cover plate by a pair of circular resilient gas-tight members 78. Recessed in the offset 31 of the cylinder plate 32 and the offset 67 of the reentrant portion 66 of the exhaust manifold housing is an annular exhaust seal ring 79, said ring being pressed against the rotor or cylinder housing 27 by a pair of circular resilient gas-tight members 80.

Each chamber 28 is provided, near the lower end thereof, with a fuel intake port 81 and a burnt fuel exhaust port 82, said ports being longitudinally aligned and facing, respectively, the front and rear ends of the engine.

Figure 7:
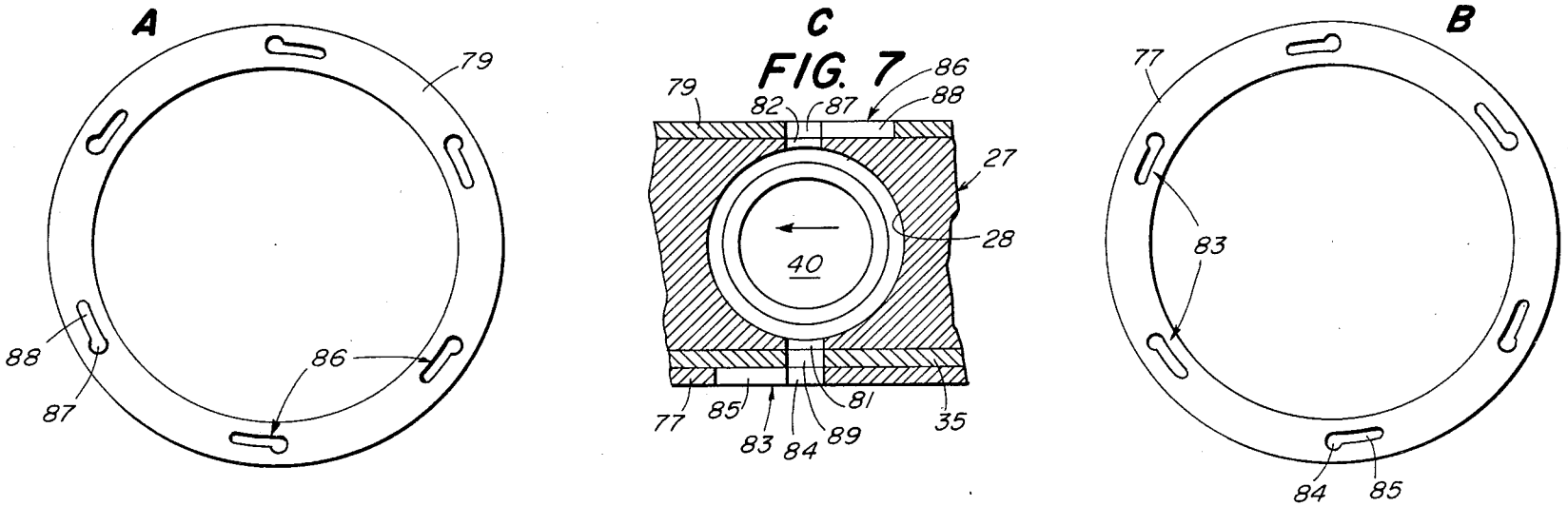
FIG. 7 is a diagramatic view showing, in sub-figures A and B thereof, the porting means of exhaust and intake seal rings of the engine and, in sub-figure C thereof, the relationship between said seal porting means and exhaust and intake ports of a particular cylinder of the engine at the moment of maximum flow alignment thereof.

As best shown in FIG. 7 of the drawings, the intake seal ring 77 is provided with six similar fuel intake ports generally designated by the reference character 83, each such port comprising a substantially circular portion 84 at one end thereof and a slotted or elongated tail portion 85 extending from said circular portion in the direction of the rotation of the rotor or cylinder housing 27.

The exhaust seal ring 79 is, likewise, provided with six similar exhaust ports 86 and each such port includes a circular portion 87 from which extends, in the direction contrary to the direction of rotation of the rotor 27, a tail portion 88.

The cover plate 35 of the rotor 27 is, like the chambers 28, provided with intake ports 89 aligned with the ports 81 of said chambers.

The intake manifold 76 is in open communication with the intake seal ring ports 83 through an annular passage 90, and the exhaust manifold 68 is in communication with the exhaust seal ring ports 86 through an annular passage 91.

Secured to the plate 71 of the intake manifold housing 70, as by bolts 92, is a dish-shaped front end cover plate 93 which, together with the wall of said plate 71, provides a fuel pressurizing blower housing generally designated by the reference character 94. Said blower housing is provided with an intake mounting 95 (FIGS. 1 and 5) connected in a conventional manner to a carburetor (not shown), and a portion 96 of the lip of the cover plate 93 of said housing has an increasing radius of curvature so as to provide an expanding housing area. Adjacent to the end of the housing 94 of greatest area, said housing communicates, through a port 97, with the intake manifold 76.

A pressurizing blower wheel 98 is enclosed within the housing 94, said wheel having, at its inner end, a hub 99 mounted on needle bearings 100 which ride on the stepped portion 22 of the shaft 19. At its outer end, said wheel is provided with fuel velocity-generating elements 101. The wheel hub 99 is provided with gear teeth 102 meshing with a gear 103 which is rotatably mounted on a stub shaft 104 anchored in the wall 71 of the manifold 76. Pinned, as at 105, to the gear 103 is a pinion 106 rotatably mountd on the stub shaft 104 and meshing with a gear 107 keyed, as at 108, to the step 22 of the shaft 19.

A dish-shaped rear end cover plate 109 is secured, as by bolts 110, to the engine housing 15, and also secured to said engine housing by the same bolts, is a circular plate 111, the latter, together with said rear end cover plate, providing a fly-wheel housing in which there is enclosed a fly-wheel 112 keyed, as at 113, to the stepped portion 26 of the shaft 19.

The annulus 65 of the plate 62 has a rearwardly directed portion 114 of increasing radius of curvature, said portion 114, together with the plate 62 of the exhaust manifold housing 61 and the inner surface of the plate 111 providing a scavenging housing 115 which communicates, through a port 116, with the burnt fuel exhausting manifold 68. The scavenging housing communicates with a stack 117 (FIG. 6) leading to the atmosphere.

A scavenger wheel 118 is enclosed within the housing 115, said wheel having, at its inner end, a hub 119 mounted on needle bearings 120 which ride on the stepped portion 25 to the shaft 19. At its outer end, said wheel is provided with such peripheral elements 121 that when said wheel is rotated at high speed, suction is created in the housing 115 to pull burnt fuel gases from the exhaust manifold 68. The wheel hub 119 is provided with a gear 122 which meshes with a gear 123 rotatably mounted on a stub shaft 124 anchored in the wall 62 of the manifold 68. Pinned, as at 125, to the gear 123 is a pinion 126 rotatably mounted on the stub shaft 124 and meshing with a gear 127 keyed, as at 128, to the step 25 of the shaft 19.

Six spark plugs 129 are mounted in the engine housing 15 at angular locations corresponding substantially to the three peaks of each of the cams 51 and 56.

Figure 5:
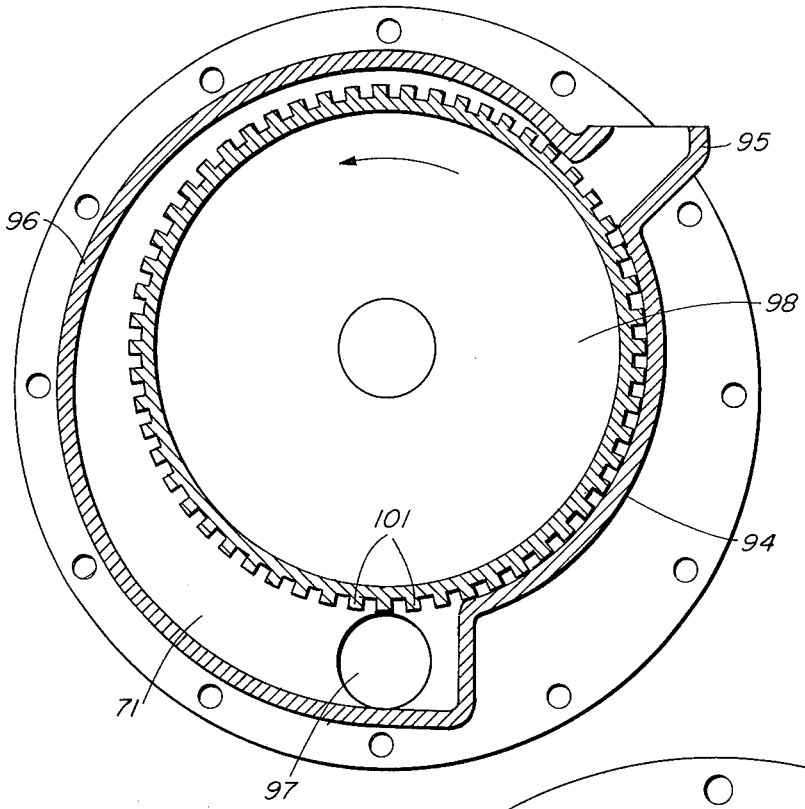
FIG. 5 is a reduced, transverse view of the fuel-pressuring blower of the engine, looking from the front end of said engine.
Figure 6:
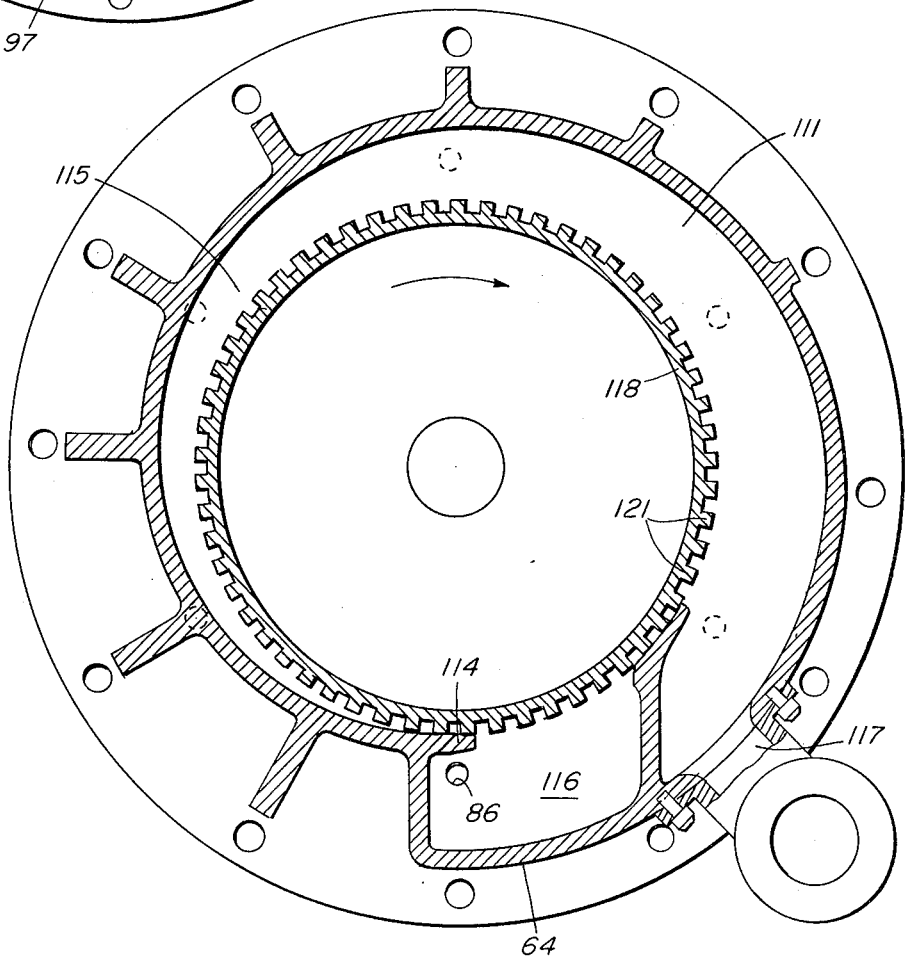
FIG. 6 is a reduced, transverse view of a burnt fuel-scavenger of the engine, looking from the rear of said engine.

This completes the description of the mechanical construction of the first embodiment of the rotary-radial internal combustion engine of the present invention, and the operation thereof may be summarized as follows:

Vaporized fuel from a carburetor is fed to the engine by way of the mounting 95 (FIGS. 1 and 5). It enters the fuel pressurizing blower housing 94 where it is whirled by the blower wheel 98 so as to maintain a substantially constant pressure. The pressurized gaseous fuel passes from the housing 94 through the port 97 into the intake manifold 76. From the manifold 76 the fuel enters the combustion chambers 28 as the aligned ports 81 and 89 of the rotor or cylinder housing 27 pass by the intake seal ring ports 83.

At appropriate times, energizing of the spark plugs 129 explodes such fuel to bring about the expansion strokes of those pistons 40 which are then substantially in their uppermost positions in the chambers 28, corresponding substantially to the peaks of the cams 51 and 56. The piston thrust thus developed is transmitted, through the cam follower rollers 50 and 55, to the cams 51 and 56 which, being fixed against rotation in the engine housing 15, generate a reactive force. This force is transmitted back, through the cam follower rollers 50 and 55, to the pistons 40 and chambers 28 to cause rotation of the cylinder housing 27. Rotation of the latter has a fly-wheel effect and applies torque to the drive shaft 19.

As each piston 40 moves toward the bottom of its stroke, its combustion chamber ports 81 and 82 become covered until substantially the bottom of the stroke is reached. At this time, the exhaust port 82 is uncovered and, as the combustion chamber 28 of such piston passes by the exhaust port 86 of the exhaust seal ring 79, the burnt gases in such chamber commence to exhaust through the port 91 into the exhaust manifold 68.

As the cylinder housing 27 reaches a point in its rotation where the circular portion of the exhaust port 86 and the circular portion of the intake port 83 become aligned, fresh fuel from the intake manifold 76 commences to enter the chamber 28 and this action assists in the purging of the burnt gas. As the cylinder housing continues to rotate and the chamber passes the tail portion of the port 83, such chamber continues to take on a fresh charge of fuel which becomes compressed as the piston 40 therein travels upwardly through its compression stroke.

The burnt gases in the exhaust manifold 68 are pulled through the port 116 by the suction developed by the rotation of the scavenger wheel 118 in the scavenging housing 115, and such gases are discharged from such scavenging housing through the stack 117.

When the piston reaches the top of its stroke, the cycle just described repeats.

Figure 9:
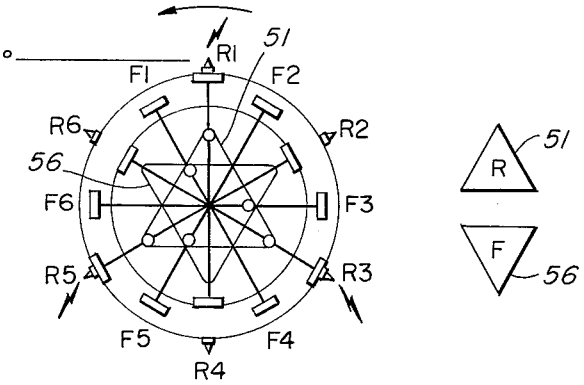
FIG. 9 is a view showing, in sub-figures A, B, C and D thereof, sequential, diagramatic radial positions and charted functions of the pistons of a 12-cylinder engine made in accordance with the present invention, as said pistons rotate from zero degrees to 30°, then to 60° and then to 90° of the 360° of an engine revolution.
Figure 9:
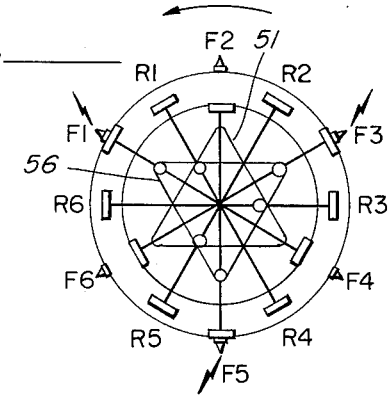
Figure 9:
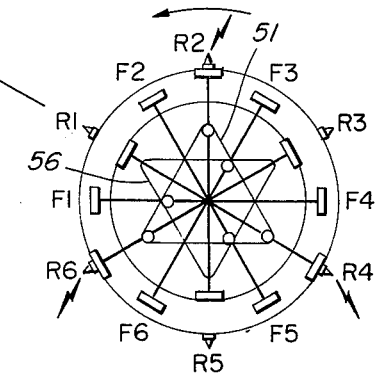
Figure 9:
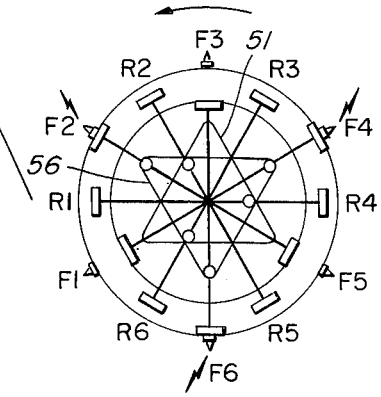

In order to more clearly understand the functioning of the engine of the present invention, reference is now made to FIG. 9 of the drawings.

In this figure, the pistons 40 of three pairs of diamtrically opposite pistons, which, through struts 43 and cam follower rollers 50, engage the rear cam 51, have been designated by the symbols R1 through R6, and the pistons 40 of three other pairs of diametrically opposite pistons, which, through struts 43 and cam follower rollers 55, engage the front cam 56, have been designated by the symbols F1 through F6.

Thus, there is being described a rotary-radial engine incorporating 12 cylinders and two cams, in effect, two 6-cylinder 2-cycle engines in one engine housing, in which there are 36 firings per engine revolution. However, it is to be clearly understood that the present invention is not limited to an engine having that number of cylinders and cams. The construction and principles of the present invention apply to any engine having an even number of cylinders and can apply to an engine having a single cam.

In all of the diagramatic views of FIG. 9 (sub-figures A, B, C and D thereof), the assumed direction of rotation of the rotor or piston-containing housing, as one views the engine from the front, is indicated by counter-clockwise arrows.

In sub-figure A of FIG. 9, the piston R1 is shown at an instant in time corresponding, as a reference, to zero degrees of rotor rotation. It is substantially at the top of its stroke, its firing position, as indicated by the flashing symbol *N*. At the same instant in time, the pistons R5 and R3 are in similar firing positions.

As shown in the chart to the left in sub-figure A, while the pistons R1, R5 and R3 are thus located, their diametrically opposite pistons R4, R2 and R6, are substantially at the bottom of their strokes, corresponding to their burnt fuel exhaust and fresh fuel intake positions.

At the same time, the pistons F1, F5 and F3 are on their way toward firing, in their compression positions, and their diametrically opposite pistons F6, F4 and F2 are in their downstrokes corresponding to expansion positions.

From the diagramatic and charted portions of sub-figure B of FIG. 9, which represents piston position after 30° of rotation from the positions in sub-figure A, it is to be noted that pistons R1, R5 and R3, previously in firing positions, are now in their expansion downstrokes, while the diametrically opposite pistons R4, R2 and R6, previously in their exhaust-intake positions, are now in their upstroke compression positions.

At the same time, the pistons F1, F5 and F3, previously in their upstroke compression positions, are now in their firing positions, and the diametrically opposite pistons F6, F4 and F2, previously in their downstroke expansion positions, are now in their bottom of the stroke exhaust-intake positions.

As shown in sub-figure C of FIG. 9, which represents the piston positions after 60° of rotation from the positions in sub-figure A, it is to be noted that pistons R1, R5 and R3, previously in their expansion downstrokes, are now in their exhaust-intake positions, and the diametrically opposite pistons R4, R2 and R6, previously in their upstroke compression positions, are now in their firing positions.

At the same time, the pistons F1, F5 and F3, previously in their firing positions, are now in their downstroke expansion positions, and their diametrically opposite pistons F6, F4 and F2, previously in their exhaust-intake positions, are now in their upstroke compression positions.

Finally, as will be noted from sub-figure D of FIG. 9, which represents the piston positions after 90° of rotation from the positions in sub-figure A, pistons R1, R5 and R3, previously in their exhaust-intake positions, are now in their upstroke compression positions, while the diametrically opposite pistons R4, R2 and R6, previously in their firing positions, are now in their downstroke expansion positions.

At the same time, the pistons F1, F5 and F3, previously in their expansion positions, are now in their bottom exhaust-intake positions, while the diametrically opposite pistons F6, F4 and F2, previously in their upstroke compression positions, are now in their firing positions.

Thus, it is to be noted that during the 90° of rotation depicted in FIG. 9, each of the 12 cylinders of the engine has been fired once and, therefore, each of the pistons R1 through R6 and F1 through F6 has been stroked once, such firing and such stroking occurring three times, in multiples of three events for each time, during each complete engine revolution.

For a still further understanding of the present invention, reference is made to FIG. 8 of the drawings.

In this figure, the direction of rotation of the rotor or piston-containing housing, again, looking from the front end of the engine, is indicated by a counter-clockwise arrow.

A single piston 40 is shown, in phantom, as it rotates in increments of 15° from one firing position, labeled "X", to its immediately succeeding firing position labeled "Y", and as it is reciprocated during each such rotational travel, by the front cam 56 with which it is engaged, from the first firing position, through its expansion downstroke, to its exhaust-intake position at the bottom of such stroke and back, through its compression upstroke, to its next firing position.

There is also shown in this figure the relationship between the aligned cylinder intake-exhaust ports 82–81, the elongated exhaust and intake ports, respectively, 86 and 83 of the stationary exhaust and intake seal rings 79–77, and the piston 40 as it approaches, covers and then exposes such seal seal ring ports.

It is to be noted that as the piston travels, under the combined influence of the slope of the cam and the rotation of the cylinder housing, from one firing position to the next firing position, a point labeled "P" on such piston is caused to generate a substantially flat line. As a result of such travel, two important consequences follow: (1) the thrust of the piston is, as stated earlier in this specification, immediately translated into torque with a minimum of incremental shaft rotation, and (2) the period of communication between the combustion chamber exhaust and intake ports and the seal ring exhaust and intake ports is extended, thereby achieving efficient purging of burnt fuel from the combustion chamber and the introduction of fresh fuel into said chamber.

There has thus been described the conditions of the (12) pistons of the embodiment of the invention under consideration as said pistons reciprocate in their combustion chambers and the rotor incorporating the same rotates through 90° of an engine revolution. During each complete revolution of the engine, the foregoing cycle occurs three times.

Figure 10:
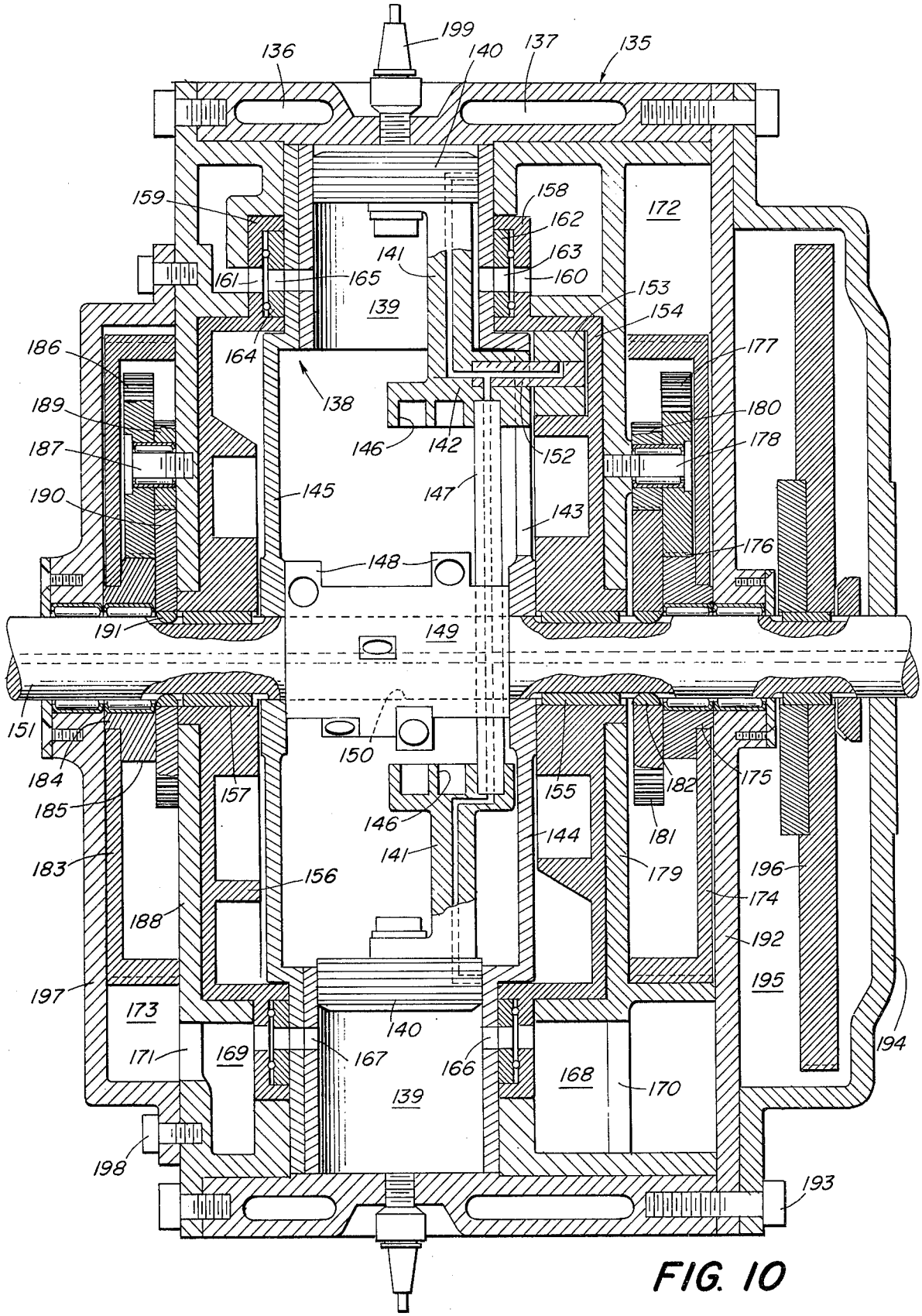
FIG. 10 is an assembled and enlarged, longitudinal sectional view similar to FIG. 2, but showing a modified form of the engine of the present invention.
Figure 11:
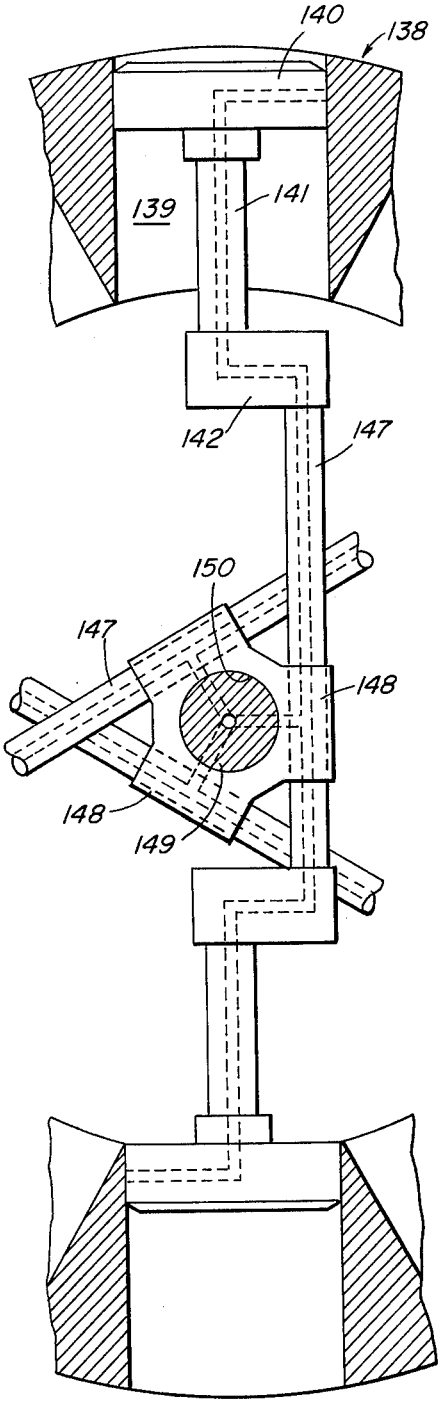
FIG. 11 is a fragmentary view showing the manner of rigidly connecting diametrically opposite pistons in the modified form of the invention shown in FIG. 10.

This completes the description of the structure and operation of the first embodiment of the engine of the present invention and reference will now be made to FIGS. 10 and 11 of the drawings for a description of the modified form of such invention.

In said figures, the numeral 135 generally designates an engine housing having annular channels 136 and 137 in which cooling fluid is intended to be circulated.

Enclosed in said housing 135 is a cylinder housing generally designated by the reference character 138, said cylinder housing being in all respects similar to the cylinder housing 27 of the first embodiment of the present invention, except that, in this form of the invention, the cylinder housing is fixed rather than being rotatable.

It incorporates a plurality of peripheral combustion chambers 139 in which there are reciprocating pistons 140 having struts 141 secured to the undersides thereof. Certain of such struts are provided with rearwardly directed arms 142 which extend at right angles thereto and are engaged in and guided by radial slots 143 in the rear wall 144 of the cylinder housing 138. Certain others of said struts 141 (not shown) are provided with forwardly directed arms engaged in radial slots in a front cover plate 145 of the cylinder housing 138.

The struts 141 are provided with threaded sockets 146 receptive of oppositely threaded rigid links 147 which connect diametrically opposite pistons 140, said links passing through apertured lugs 148 formed on a link guiding member 149 fixedly mounted in the engine housing 135 and provided with a central bore 150. Rotatably mounted in the bore 150 is the main engine drive shaft 151.

The struts 141 which include rearwardly directed arms 142 carry stub shafts 152 on which are rotatably mounted cam follower rollers 153 engaging a rear cam 154. Such cam is similar to the rear cam 51 of the first embodiment of this invention, except that it is keyed, as at 155, to the shaft 151 and is therefore rotatable with respect to the engine housing 135 and the cylinder housing 138.

The struts 141 which include, as above stated, forwardly directed arms 142 likewise carry stub shafts provided with cam follower rollers, the latter engaging a front cam 156 which is similar to the front cam 56 of the first embodiment of the invention, except that such cam is keyed, as at 157, to the shaft 151 and is, like the rear cam 153, rotatable with respect to the engine housing 135 and the cylinder housing 138.

The cams 153 and 156 are provided, respectively, with peripheral extensions 158 and 159, the former including an annular passage 160 and the latter including an annular port 161. The extension 158 houses an exhaust seal ring 162 having elongated exhaust ports 163 similar to the ports 86 of the ring 79 of the first embodiment of this invntion. The extension 159 houses an intake seal ring 164 having elongated intake ports 165 similar to the ports 83 of said first embodiment. The seal rings 162 and 164 are resiliently urged, respectively, against the rear and front walls of the cylinder housing 138, and the combustion chambers 139 thereof are provided with aligned exhaust and intake ports 166 and 167.

A housing, which includes an annular burnt fuel exhausting manifold 168 open to the annular passage 160, surrounds the rear cam 154 and another housing, which includes an annular fuel intake manifold 169 open to the annular passage 161, surrounds the front cam 156. The manifolds 168 and 169 are provided, respectively, with ports 170 and 171.

The ports 170 and 171 provide communication, respectively, between the burnt fuel exhausting manifold 168 and a scavenging housing 172 and between the fuel intake manifold 169 and a fuel pressurizing housing 173. The housings 172 and 173, like the housings 115 and 94 of the first embodiment of this invention, are of annularly expanding areas.

The scavenging housing 172 encloses a scavenger wheel 174 which is rotatably mounted on the shaft 151. Its hub 175 includes a gear 176 meshing with a gear 177 rotatably mounted on a stub shaft 178 anchored in a wall 179 separating and partially defining the exhaust manifold 168 and the scavenging housing 172. The gear 177 is pinned to a pinion 180, also rotatably mounted on the stub shaft 178, and said pinion meshes with a gear 181 keyed, as at 182, to the shaft 151.

The pressurizing housing 173 encloses a pressurizing blower wheel 183 which is rotatably mounted on the shaft 151. Its hub 184 includes a gear 185 meshing with a gear 186 rotatably mounted on a stub shaft 187 anchored in a wall 188 separating and partially defining the intake manifold 169 and the pressurizing housing 173. The gear 183 is pinned to a pinion 189, also rotatably mounted on the stub shaft 187, and said pinion meshes with a gear 190 keyed, as a 191, to the shaft 151.

The scavenging housing 172 is partially defined by a wall 192 secured by bolts 193 to the engine housing 135. Said wall, together with a dish-shaped rear cover plate 194, also secured to the engine housing by the same bolts, define a fly-wheel housing 195 in which is enclosed a fly-wheel 196 secured to the shaft 151. The pressurizing housing 173 is partially defined by a dish-shaped front cover 197 which is secured to the engine housing 135 by bolts 198.

This embodiment of the invention is completed by spark plugs 199 angularly located in the engine housing 135 in the same manner as are the plugs 129 in the first embodiment of this invention.

This completes the description of the physical structure of the modified form of the present invention disclosed in FIGS. 10 and 11 of the drawings, and the operation thereof may be summarized as follows:

Vaporized fuel is fed to the pressurizing housing 173 wherein it is whirled by the wheel 183 to maintain a substantially constant pressure. It passes from said housing into the intake manifold 169 from whence it enters the combustion chambers 139 in the following manner.

Whereas, in the first embodiment of this invention, the front cam 56 and the intake seal ring 77 are fixed in the engine housing and the combustion chambers 28 rotate, so that fuel from the intake manifold 76 enters said chambers as the intake ports 81 and 89 thereof pass by the seal rings ports 83, in the modified form of the invention being described, the front cam 156 and intake seal ring 164 carried thereby rotate and the combustion chambers 139 are fixed against rotation, so that fuel from the intake manifold 169 enters said chambers as the seal ring intake ports 165 pass by the intake ports 167 of said chambers.

As the fuel in the chambers 139 is exploded in properly timed sequence, the pistons 140 are reciprocated and the thrust thereby developed is applied to the cams 156 and 154 through the cam follower rollers 153. Inasmuch as said cams are rotatable in the engine housing and keyed to the shaft 151, the piston force transmitted to the cams is translated by the latter into torque and the shaft 151 is rotated thereby.

Burnt fuel is exhausted from the combustion chambers 139 as the rotating seal rings ports 163 pass by the exhaust ports 166 of said chambers. Such fuel is sucked into the exhaust manifold 168, from whence it passes into the scavenging housing 172 through the port 170. The rotating scavenger wheel 174 ejects said burnt fuel from the scavenging housing 172 through a stack (not shown).

This completes the description of the mechanical operation of the modified form of the invention shown in FIGS. 10 and 11 of the drawings and the explanation of the principles of the present invention set forth in connection with the description of FIGS. 9 and 8 apply to the modification in the same manner as they do to the first embodiment of the invention. The basic difference between the two forms of the invention is that in one, the combustion chambers rotate while the cams are stationary whereas in the other, the cams rotate and the combustion chambers are stationary.

It will be noted from all of the foregoing that there has been presented a rotary-radial internal combustion engine satisfying the objects and advantages set forth in the body hereof preceding the brief description of the drawings.

What is claimed is:

1. An internal combustion engine comprising: an engine housing, a cylinder housing, and cam means; said cylinder housing and said cam means being mounted in said engine housing for relative rotary motion with respect to each other; said cylinder housing incorporating at least one pair of diametrically opposite combustion chambers each of which contains a piston mounted for reciprocation therein; a rigid link connecting diametrically opposite pistons of each pair thereof, each such link being of such length that when each piston connected thereto is at the top of its stroke, the diametrically opposite piston is at the bottom of its stroke; cam follower means carried by one piston of each pair of diametrically opposite pistons and engaging said cam means; a drive shaft rotatably mounted in said engine housing and being receptive of and driven by the relative rotary motion between said cylinder housing and said cam means; means for supplying fuel to said combustion chambers under pressure; means for firing said fuel in said combustion chambers; and means for scavenging the resulting burnt fuel from said combustion chambers.

2. An internal combustion engine as recited in claim 1, wherein said cylinder housing includes a plurality of peripherally disposed, radially oriented combustion chambers separated by walls incorporating sealing members providing a close fit with the inner surface of said engine housing; a wall extending from said combustion chambers toward the center of the engine on each side of said cylinder housing; and a hub formed at the inner end of each of said walls receptive of said drive shaft.

3. An internal combustion engine as recited in claim 1, wherein said cam means includes first and second similar cam members axially and angularly displaced with respect to each other; and said cam follower means includes first and second sets of cam follower members; each of the cam follower members of one such set thereof being carried by one piston of a selected pair of diametrically opposite pistons and engaging the first of said cam members, and each of the cam follower members of the other such set thereof being carried by one piston of another selected pair of diametrically opposite pistons and engaging the second of said cam members.

4. An internal combustion engine as recited in claim 1, wherein said cam means includes similar first and second cam members axially displaced with respect to each other and disposed on opposite sides of said cylinder housing; said cam members also being angularly displaced with respect to each other by the distance between the center lines of alternate combustion chambers of said cylinder housing; and said cam follower means includes first and second sets of cam follower members; the cam follower members of each such set thereof being carried, respectively, by one piston of selected pairs of diametrically opposite pistons and alternately engaging said first and second cam members.

5. An internal combustion engine as recited in claim 1, wherein said cam means includes two similar channel members lying, respectively, in planes parallel to the diametral plane of said cylinder housing and being disposed on opposite sides thereof; said channel members having such slopes that points thereon coincident with the center lines of alternate pistons correspond, respectively, to the top and bottom of the strokes of said pistons, and points intermediate said first-named points lie along a curve bearing such a relationship to the strokes of said pistons and the rate of expansion of the gases resulting from the firing of fuel in said combustion chambers, that the thrust of said pistons is converted into torque on said drive shaft with a minimum related rate of incremental rotation of said shaft.

6. An internal combustion engine as recited in claim 1, wherein the rigid link connecting diametrically opposite pistons includes struts secured to said pistons, one of each such struts being slidably engageable with the cylinder housing for radially and laterally guiding the same as said pistons reciprocate in their combustion chambers; a stub shaft carried by said lastnamed strut; and a cam follower roller rotatably mounted on said stub shaft and engaging said cam means.

7. An internal combustion engine as recited in claim 1, wherein said means for supplying fuel to said combustion chambers includes a fuel intake housing incorporated in said engine housing and communicating with a source of gaseous fuel, said intake housing having an increasing radius of curvture providing the same with a gradually expanding area; a pressurizing blower wheel rotatably mounted in said intake housing and geared to and driven by said drive shaft for maintaining the fuel in said intake housing at a substantially constant pressure; and a ported seal ring interposed between said intake housing and said cylinder housing for providing controlled periodic communication between said intake housing and said combustion chambers.

8. An internal combustion engine as recited in claim 1, wherein said means for supplying fuel to said combustion chambers includes a fuel intake housing incorporated in said engine housing and communicating with a source of gaseous fuel, said intake housing having an increasing radius of curvature providing the same with a gradually expanding area; a fuel intake manifold incorporated in said engine housing and having open communication with said fuel intake housing; a pressurizing blower wheel rotatably mounted in said intake housing and driven by said drive shaft for supplying fuel to said intake manifold and maintaining the same therein at a substantially constant pressure; and a ported seal ring intermediate said intake manifold and said cylinder housing for providing controlled periodic communication between said intake manifold and said combustion chambers.

9. An internal combustion engine as recited in claim 1, wherein said means for scavenging burnt fuel from said combustion chambers includes a scavenging housing incorporated in said engine housing and communicating with the atmosphere, said scavenging housing having an increasing radius of curvature providing the same with a gradually expanding area; a scavenger wheel rotatably mounted in said scavenging housing and geared to and driven by said drive shaft for maintaining suction into said scavenging housing at a substantially constant level; and a ported seal ring interposed between said scavenging housing and said cylinder housing for providing controlled periodic communication between said scavenging housing and said combustion chambers.

10. An internal combustion engine as recited in claim 1, wherein said means for scavenging burnt fuel from said combustion chambers includes a scavenging housing incorporated in said engine housing and communicating with the atmosphere, said scavenging housing having an increasing radius of curvature providing the same with a gradually expanding area; a burnt fuel exhaust manifold incorporated in said engine housing and having open communication with said scavenging housing; a scavenger wheel rotatably mounted in said scavenging housing and driven by said drive shaft for maintaining suction from said exhaust manifold into said scavenging housing at a substantially constant level; and a ported seal ring intermediate said exhaust manifold and said cylinder housing for providing controlled periodic communication between said combustion chambers and said exhaust manifold.

11. An internal combustion engine as recited in claim 1, wherein said means for supplying fuel to said combustion chambers and said means for scavenging burnt fuel from said chambers include, respectively, a fuel intake housing incorporated in said engine housing and communicating with a source of gaseous fuel, and a scavenging housing incorporated in said engine housing and communicating with the atmosphere; said intake and scavenging housings having increasing radii of curvature providing the same with gradually expanding areas; pressurizing and scavenging wheels rotatably mounted, respectively, in said intake and scavenging housings and geared to and driven by said drive shaft for manintaining the fuel in said intake housing at a substantially constant pressure, and for maintaining suction in said scavenging housing at a substantially constant level; and seal rings interposed between said intake and scavenging housings and said cylinder housing, said seal rings being provided, respectively, with partially overlapping, elongated intake and exhaust ports providing controlled periodic communication between said intake and scavenging housings and said combustion chambers.

12. An internal combustion engine comprising: an engine housing; a drive shaft rotatably mounted in said engine housing; a rotor carried by and secured to said drive shaft and enclosed in said housing; said rotor incorporated at least one pair of diametrically opposite combustion chambers; a pistonmounted for reciprocation in each such combustion chamber; a rigid link connecting the diametrically opposite pistons of each such pair thereof; each such link being of such length that when each piston connected thereto is substantially at the top of its stroke, the diametrically opposite piston is substantially at the bottom of its stroke; cam means enclosed in said engine housing and fixed against rotation with respect to said rotor; cam follower means carried by one piston of each pair of diametrically opposite pistons and engaging said cam means; means for supplying fuel to said combustion chambers at a substantially constant pressure; means for firing said fuel in said combustion chambers; and means for scavenging the resulting burnt fuel from said combustion chambers.

13. An internal combustion engine as recited in claim 12, wherein said rotor includes a plurality of peripherally disposed, radially oriented combustion chambers separated by walls incorporating sealing members providing a close fit with the inner surface of said engine housing; a wall extending from said combustion chambers toward the center of the engine on each side of said rotor; and a hub formed at the inner end ofeach of said walls receptive of and keyed to said drive shaft.

14. An internal combustion engine as recited in claim 12, wherein said cam means includes first and second similar cam members axially and angularly displaced with respect to each other; and said cam follower means includes first and second sets of cam follower members; each of the cam follower members of one such set being carried by one piston of a selected pair of diametrically opposite pistons and engaging the first of said cam members, and each of the cam follower members of the other such set thereof being carried by one piston of another selected pair of diametrically opposite pistons and engaging the second of said cam members.

15. An internal combustion engine as recited in claim 12, wherein said cam means includes similar first and second cam members axially displaced with respect to each other and disposed on opposite sides of said rotor, said cam members also being angularly displaced with respect to each other by the distance between the center lines of alternate combustion chambers of said rotor; and said cam follower means includes first and second sets of cam follower members, the cam follower members of each such set thereof being carried, respectively, by one piston of selected pairs of diametrically opposite pistons and alternately engaging said first and second cam members.

16. An internal combustion engine as recited in claim 12, wherein said cam means includes two similar channel members lying, respectively, in planes parallel to the diametral plane of said rotor and being disposed on opposite sides thereof; said channel members having such slopes that points thereon coincident with the center lines of alternate pistons correspond, respectively, to the top and bottom of the strokes of said pistons, and points intermediate said first-named points lie along a curve bearing such a relationship to the strokes of said pistons and the rate of expansion of the gases resulting from the firing of fuel in said combustion chambers, that the thrust of said pistons is converted into torque on said drive shaft with a minimum related rate of incremental rotation of said shaft.

17. An internal combustion engine as recited in claim 12, wherein said rigid link connecting diametrically opposite pistons passes freely through said drive shaft; and such connection includes struts secured to said pistons and being receptive of the ends of said rigid link.

18. An internal combustion engine as recited in claim 12, wherein said means for supplying fuel to said combustion chambers includes a fuel intake housing incorporated in said engine housing and communicating with a source of gaseous fuel, said intake housing having an increasing radius of curvature providing the same with a gradually expanding area; a pressurizing blower wheel rotatably mounted in said intake housing and geared to and driven by said drive shaft for maintaining the fuel in said intake housing at a substantially constant pressure; and a ported seal ring interposed between said intake housing and said cylinder housing for providing controlled periodic communication between said intake housing and said combustion chambers.

19. An internal combustion engine as recited in claim 12, wherein said means for supplying fuel to said combustion chambers includes a fuel intake housing incorporated in said engine housing and communicating with a source of gaseous fuel, said intake housing having an increasing radius of curvature providing the same with a gradually expanding area; a fuel intake manifold incorporated in said engine housing and having open communication with said fuel intake housing; a pressurizing blower wheel rotatably mounted in said intake housing and driven by said drive shaft for supplying fuel to said intake manifold and maintaining the same therein at a substantially constant pressure; and a ported seal ring intermediate said intake manifold and said rotor for providing controlled periodic communication between said intake manifold and said combustion chambers.

20. An internal combustion engine as recited in claim 12, wherein said means for scavenging burnt fuel from said combustion chambers includes a scavenging housing incorporated in said engine housing and communicating with the atmosphere, said scavenging housing having an increasing radius of curvature providing the same with a gradually expanding area; a scavenger wheel rotatably mounted in said scavenging housing and geared to and driven by said drive shaft for maintaining suction into said scavenging housing at a substantially constant level; and a ported seal ring interposed between said scavenging housing and said rotor for providing controlled periodic communication between said scavenging housing and said combustion chambers.

21. An internal combustion engine as recited in claim 12, wherein said means for scavenging burnt fuel from said combustion chambers includes a scavenging housing incorporated in said engine housing and communicating with the atmosphere, said scavenging housing having an increasing radius of curvature providing the same with a gradually expanding area; a burnt fuel exhaust manifold incorporated in said engine housing and having open communication with said scavenging housing; a scavenger wheel rotatably mounted in said scavenging housing and driven by said drive shaft for maintaining suction from said exhaust manifold into said scavenging housing at a substantially constant level; and a ported seal ring intermediate said exhaust manifold and said rotor for providing controlled periodic communication between said combustion chambers and said exhaust manifold.

22. An internal combustion engine as recited in claim 12, wherein said means for supplying fuel to said combustion chambers and said means for scavenging burnt fuel from said combustion chambers include, respectively, a fuel intake housing incorporated in said engine housing and communicating with a source of gaseous fuel, and a scavenging housing incorporated in said engine housing and communicating with the atmosphere; said intake and scavenging housings having increasing radii of curvature providing the same with gradually expanding areas; pressurizing and scavenging wheels rotatably mounted, respectively, in said intake and scavenging housings and geared to and driven by said drive shaft for maintaining the fuel in said intake housing at a substantially constant pressure, and for maintaining suction in said scavenging housing at a substantially constant level; and seal rings interposed between said intake and scavenging housings and said rotor, said seal rings being provided, respectively, with partially overlapping, elongated intake and exhaust ports providing controlled periodic communication between said intake and scavenging housings and said combustion chambers.

23. An internal combustion engine comprising: an engine housing; a drive shaft rotatably mounted in said engine housing; cam means carried by and secured to said drive shaft and enclosed in said engine housing; a cylinder housing enclosed in said engine housing and fixed against rotation with respect to said cam means; said cylinder housing incorporating at least one pair of diametrically opposite combustion chambers; a piston mounted for reciprocation in each such combustion chamber; a rigid link connecting the diametrically opposite pistons of each such pair thereof; each such link being of such length that when each piston connected thereto is at the top of its stroke, the diametrically opposite piston is substantially at the bottom of its stroke; cam follower means carried by one piston of each pair of diametrically opposite pistons and engaging said cam means; means for supplying fuel to said combustion chambers at a substantially constant pressure; means for firing said fuel in said combustion chambers; and means for scavenging the resulting burnt fuel from said combustion chambers.

24. An internal combustion engine as recited in claim 23, wherein said cylinder housing includes a plurality of peripherally disposed, radially oriented combustion chambers separated by walls incorporating sealing members isolating said combustion chambers from each other; and a wall extending from said combustion chambers toward the center of the engine on each side of said cylinder housing, said walls being apertured at the center of the engine to rotatably receive said drive shaft.

25. An internal combustion engine as recited in claim 23, wherein said cam means includes first and second similar cam members axially and angularly displaced with respect to each other; and said cam follower means includes first and second sets of cam follower members; each of the cam follower members of one such set thereof being carried by one piston of a selected pair of diametrically opposite pistons and engaging the first of said cam members, and each of the cam follower members of the other such set thereof being carried by one piston of another selected pair of diametrically opposite pistons and engaging the second of said cam members.

26. An internal combustion engine as recited in claim 23, wherein said cam means includes similar first and second cam members axially displaced with respect to each other and disposed on opposite sides of said cylinder housing, said cam members also being angularly displaced with respect to each other by the distance between the center lines of alternate combustion chambers of said cylinder housing; and said cam follower means includes first and second sets of cam follower members, the cam follower members of each such set thereof being carried, respectively, by one piston of selected pairs of diametrically opposite pistons and alternately engaging said first and second cam members.

27. An internal combustion engine as recited in claim 23, wherein said cam means includes two similar channel members lying, respectively, in planes parallel to the diametral plane of said cylinder housing and being disposed on opposite sides thereof; said channel members having such slopes that points thereon coincident with the center lines of alternate pistons correspond, respectively, to the top and bottom of the strokes of said pistons, and points intermediate said first-named points lie along a curve bearing such a relationship to the strokes of said pistons and the rate of expansion of the gases resulting from the firing of fuel in said combustion chambers, that the thrust of said pistons is converted, through said cam follower and said cam means, into torque on said drive shaft with a minimum related rate of incremental rotation of said shaft.

28. An internal combustion engine as recited in claim 23, wherein said rigid link connecting diametrically opposite pistons passes freely through an apertured lug formed on a link guiding member fixed in said engine housing and provided with a central bore receptive of said drive shaft.

29. An internal combustion engine as recited in claim 23, wherein said means for supplying fuel to said combustion chambers includes a fuel intake housing incorporated in said engine housing and communicating with a source of gaseous fuel, said intake housing having an increasing radius of curvature providing the same with a gradually expanding area; a pressurizing blower wheel rotatably mounted in said intake housing and geared to and driven by said drive shaft for maintaining the fuel in said intake housing at a substantially constant pressure; and a ported seal ring carried by said cam means and interposed between said intake housing and said cylinder housing for providing controlled periodic communication between said intake housing and said combustion chambers.

30. An internal combustion engine as recited in claim 23, wherein said means for supplying fuel to said combustion chambers includes a fuel intake housing incorporated in said engine housing and communicating with a source of gaseous fuel, said intake housing having an increasing radius of curvature providing the same with a gradually expanding area; a fuel intake manifold incorporated in said engine housing and having open communication with said fuel intake housing; a pressurizing blower wheel rotatably mounted in said intake housing and driven by said drive shaft for supplying fuel to said intake manifold and maintaining the same therein at a substantially constant pressure; and a ported seal ring carried by said cam means intermediate said intake manifold and said rotor for providing controlled periodic communication between said intake manifold and said combustion chambers.

31. An internal combustion engine as recited in claim 23, wherein said means for scavenging burnt fuel from said combustion chambers includes a scavenging housing incorporated in said engine housing and communicating with the atmosphere, said scavenging housing having an increasing radius of curvature providing the same with a gradually expanding area; a scavenger wheel rotatably mounted in said scavenging housing and geared to and driven by said drive shaft for maintaining suction into said scavenging housing at a substantially constant level; and a ported seal ring carried by said cam means and interposed between said scavenging housing and said rotor for providing controlled periodic communication between said scavenging housing and said combustion chambers.

32. An internal combustion engine as recited in claim 23, wherein said means for scavenging burnt fuel from said combustion chambers includes a scavenging housing incorporated in said engine housing and communicating with the atmosphere, said scavenging housing having an increasing radius of curvature providing the same with a gradually expanding area; a burnt fuel exhaust manifold incorporated in said engine housing and having open communication with said scavenging housing; a scavenger wheel rotatably mounted in said scavenging housing and driven by said drive shaft for maintaining suction from said exahust manifold into said scavenging housing at a substantially constant level; and a ported seal ring carried by said cam means intermediate said exhaust manifold and said rotor for providing conrolled periodic communication between said combustion chambers and said exhaust manifold.

33. An internal combustion engine as recited in claim 23, wherein said means for supplying fuel to said combustion chambes and said means for scavenging burnt fuel from said combustion chambers include, respectively, a fuel intake housing incorporated in said engine housing and communicating with a source of gaseous fuel, and a scavenging housing incorporated in said engine housing and communicating with the atmosphere; said intake and scavenging housings having increasing radii of curvature providing the same with gradually expanding areas; pressurizing and scavenging wheels rotatably mounted, respectively, in said intake and scavening housings and geared to and driven by said drive shaft for maintaining the fuel in said intake housing at a substantially constant pressure, and for maintaining suction in said scavenging housing at a substantially constant level; and seal rings carried by said cam means interposed between said intake and scavenging housings and said rotor, said seal rings being provided, respectively, with partially overlapping, elongated intake and exhaust ports providing controlled periodic communication between said intake and scavenging housings and said combustion chambers.

34. In combination with the drive shaft of an internal combustion engine: a housing incorpor ating at least one pair of diametrically opposite combustion chambers; a pair of diametricall opposite, rigidly connected pistons mounted for reciprocation in each such pair of combustion chambers; and means, connected intermediate said pistons and said drive shaft, for translating the thrusts of each of said pistons into more then one driving impulse to said drive shaft during each revolution of said drive shaft.

35. In an interna combustion engine: a cylinder housing incorporating a combustion chamber having a fuel intake port and a burnt fuel exhaust port; a fuel intake seal ring adjacent said combustion chamber fuel intake port; a burnt fuel exhaust seal ring adjacent said combustion chamber burnt fuel exhaust port; said cylinder housing and said seal rings being mounted in said engine for relative rotary motion with respect to each other; and said seal rings being provided, respectively, with partially overlapping, elongated fuel intake and burnt fuel exhaust ports.

36. In an internal combustion engine: a cylinder housing incorporating a combustion chamber; a piston mounted for reciprocation in said combustion chamber; and means for stroking said piston in a multiple pattern during each engine revolution whereby an effective combustion chamber displacement per engine revolution is obtained equal to the physical displacement of said combustion chamber multiplied by the number of piston strokings per engine revolution.

37. A rotary-radial internal combustion engine wherein a piston-containing cylinder housing and cam means are mounted in an engine housing for relative rotary motion with respect to each other; said cylinder housing including diametrically opposite combustion chambers having mounted for reciprocation therein rigidly linked pistons provided with cam follower means engaging said cam means; said engine housing being provided with fuel intake means for feeding pressurized fuel to said combustion chambers, means for firing said fuel in said combustion chambers, and burnt fuel scavenging means for exhausting burnt fuel from said combustion chambers; the combination of said relative rotary motion between said cylinder housing and said cam means, and said reciprocatory motion of said pistons, producing per engine revolution piston thrusts numerically greater than the number of combustion chambes in said cylinder housing; said piston thrusts being translated into torque which is applied to an engine drive shaft.

* * * * *

UNITED STATES PATENT OFFICE

CERTIFICATE OF CORRECTION

Patent No. 4,038,949 Dated August 2, 1977

Inventor(s) Victor W. Farris

It is certified that error appears in the above-identified patent and that said Letters Patent are hereby corrected as shown below:

Column 2, lines 18 and 19, "receiprocatory" should read -- reciprocatory --.

Column 3, line 9, before "are" remove the comma; same line after "are" insert a comma; line 67, "reawardly" should read -- rearwardly --. Column 7, lines 4 and 5, "diamtrically" should read -- diametrically --. Column 8, line 46, cancel "seal", first occurrence; line 62, after "the", second occurrence, insert -- twelve --. Column 18, line 18, "conrolled" should read -- controlled --; line 22, "chambes" should read -- chambers --; line 32, "scavening" should read -- scavenging --; line 46, "diametricall" should read -- diametrically --; line 50, "then" should read -- than --; line 53, "interna" should read -- internal --.

UNITED STATES PATENT OFFICE

CERTIFICATE OF CORRECTION

Patent No. 4,038,949 Dated August 2, 1977

Inventor(s) Victor W. Farris

It is certified that error appears in the above-identified patent and that said Letters Patent are hereby corrected as shown below:

Column 20, line 10, "chambes" should read -- chambers --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*